US009826818B1

(12) United States Patent
Simpson-Klein

(10) Patent No.: US 9,826,818 B1
(45) Date of Patent: Nov. 28, 2017

(54) PORTABLE DEVICE FOR STORING OBJECTS

(71) Applicant: Cameron J. Simpson-Klein, Louisville, CO (US)

(72) Inventor: Cameron J. Simpson-Klein, Louisville, CO (US)

( * ) Notice: Subject to any disclaimer, the term of this patent is extended or adjusted under 35 U.S.C. 154(b) by 0 days.

(21) Appl. No.: 15/363,037

(22) Filed: Nov. 29, 2016

(51) Int. Cl.

| | |
|---|---|
| ***A63H 33/04*** | (2006.01) |
| ***A45F 3/14*** | (2006.01) |
| ***B65D 81/36*** | (2006.01) |
| ***B65D 65/02*** | (2006.01) |
| ***B65D 65/38*** | (2006.01) |
| ***A63H 33/00*** | (2006.01) |

(52) U.S. Cl.
CPC ..... *A45F 3/14* (2013.01); *A63H 33/003* (2013.01); *B65D 65/02* (2013.01); *B65D 65/38* (2013.01); *B65D 81/36* (2013.01)

(58) Field of Classification Search
CPC ..... B65D 65/02; B65D 65/38; A63H 33/003
USPC ..... 273/275, 285; 446/75
See application file for complete search history.

(56) References Cited

U.S. PATENT DOCUMENTS 1,708,318 A * 4/1929 Little ..... A63F 1/06 273/148 R
2,667,353 A * 1/1954 Lanice ..... A63F 3/0023 190/901
3,537,116 A * 11/1970 Kain ..... A47G 9/0246 4/585
4,552,713 A * 11/1985 Cavicchioli ..... A63B 53/14 264/139
4,952,073 A * 8/1990 Wieland ..... A63B 67/06 273/336
4,989,880 A * 2/1991 Gettemeier ..... A63B 67/06 273/336
5,005,841 A * 4/1991 Klick ..... A63F 3/00694 273/239
5,647,595 A * 7/1997 Knickerbocker ..... A63F 7/0023 220/62.1
5,669,837 A * 9/1997 Hauter ..... A63B 69/0086 273/DIG. 19
5,695,191 A * 12/1997 Frost ..... A63F 3/0023 273/260
8,459,649 B2 * 6/2013 Walker ..... A47G 9/083 273/286

FOREIGN PATENT DOCUMENTS

DE 19821839 A1 * 11/1999 ..... A63F 3/0023

* cited by examiner

*Primary Examiner* — Vishu Mendiratta

(57) ABSTRACT

A device for storing objects is disclosed that includes at least two layers of material, a closing device, and a partially rigid device. The layers of material are adapted to be rolled into a wrapped position for transportation, wherein at least one layer of material has a non-slip surface. The storage device also includes a partially rigid device that is disposed between the layers of material. The partially rigid device defines a flat area under a portion of the non-slip surface for placement of objects when the storage device is in an unwrapped position. The partially rigid device is adapted to be deformable in a first direction and adapted to be non-deformable in a second direction.

1 Claim, 4 Drawing Sheets

PORTABLE DEVICE FOR STORING OBJECTS

BACKGROUND

Technical Field

The present disclosure relates generally to storage devices, and more particularly to a portable device for storing objects.

Background

Children when playing with objects, such as toys, are accustomed to spreading their toys out across the space they are playing in. Moreover, children after playing with their toys usually leave them out in their play space without picking them up. Eventually, when children have to pick up their toys, they have to pick them up individually and by hand.

SUMMARY

According to the present disclosure, disadvantages and problems associated with previous techniques for storage may be reduced or eliminated.

In certain embodiments, a device for storing objects is disclosed that includes layers of material, a closing device, and a partially rigid device. The layers of material are adapted to be rolled into a wrapped position for transportation, wherein at least one layer of material has a non-slip surface. The storage device also includes a partially rigid device that is disposed between the layers of material. The partially rigid device defines a flat area under a portion of the non-slip surface for placement of objects when the storage device is in an unwrapped position. The partially rigid device is adapted to be deformable in a first direction and adapted to be non- deformable in a second direction.

Certain embodiments of the present disclosure may provide one or more technical advantages. The present disclosure provides a portable device for storing objects that may include, for example, children's toys. The storage device includes layers of material, a non-slip surface, a partially rigid device, and a closing device. During conventional playtime, children will spread their toys (e.g., Legos, Barbie Dolls, racecars, etc.) across their play space, which leads to children occupying a large amount of space. Once playtime has ended, children have to pick up their toys and place the toys in a separate device for storage.

In certain embodiments of the present disclosure, a storage device is provided with a partially rigid device, such as a partially rigid substrate, that may serve as a play area. According to one example, in an unwrapped position children may play on the surface of the partially rigid device in the storage device that defines a flat area under a non-slip surface. Thus, at least one example of the present disclosure provides for an area that serves as a play surface and confines children's play space to a particular area. A second example advantage of the present disclosure includes a storage device that may allow for easier pick-up and storage of children's toys. For example, after children are done playing with their toys on the play surface, the layers of material and the partially rigid device may be rolled into a wrapped position and a closing device secures the storage device. As the layers of material are rolled into a wrapped position, the non-slip surface may reduce movement of the toys.

Another example advantage of the present disclosure includes transportation of toys. For instance, when children travel to friends' homes or go on vacation they may bring certain toys with them. The storage device may facilitate transportation of toys from one place to another when toys are enclosed in the storage device in a wrapped position and a closing device secures the storage device. At a final destination, the children may unwrap the storage device and find their toys in the storage device generally where they were placed.

Certain embodiments of the present disclosure may include some, all, or none of the above advantages. One or more other technical advantages may be readily apparent to those skilled in the art from the figures, descriptions, and claims included herein. Moreover, while specific advantages have been enumerated above, various embodiments may include all, some, or none of the enumerated advantages.

BRIEF DESCRIPTION OF THE DRAWINGS

For a more complete understanding of the present disclosure and its features and advantages, reference is now made to the following description, taken in conjunction with the accompanying drawings, in which.

DESCRIPTION OF EXAMPLE EMBODIMENTS

Figure 1:
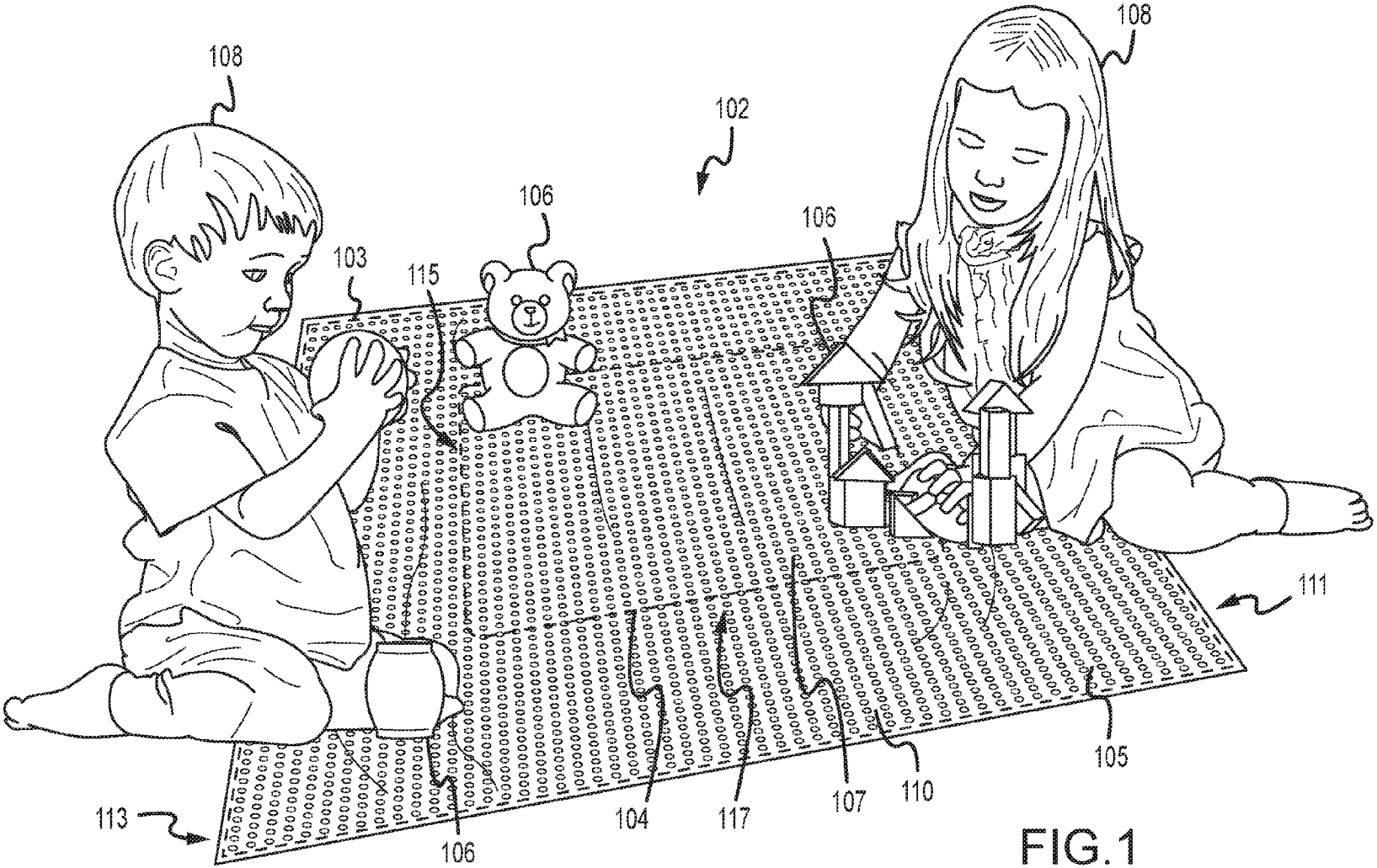
FIG. 1 illustrates an example storage device for placement and storage of objects, according to certain embodiments of the present disclosure.

FIG. 1 illustrates an example of a storage device 102 for placement and storage of objects 106, according to certain embodiments of the present disclosure. In the illustrated embodiment, storage device 102 includes a first stitching border 103, a second stitching border 104, at least two layers of material 105, objects 106, a partially rigid device 107, and a non-slip surface 110 and storage device 102 is in an unwrapped position. When storage device 102 is in an unwrapped position, a partially rigid device 107 defines a flat surface area underneath non-slip surface 110. In the unwrapped position, children 108 may place objects 106 on partially rigid device 107. Objects 106 may include, but is not limited to toys (e.g., racecars, Legos, Barbie Dolls, balls, stuffed animals, etc.). Partially rigid device 107 is adapted to be deformable in a first direction 115 and adapted to be non-deformable in a second direction 117. This deformability may facilitate storage and transportation of objects 106. For example, material 105 and partially rigid device 107 may be adapted to be rolled in first direction 115. In the example, partially rigid device 107 may be deformable when rolled in the first direction. By rolling and enclosing objects 106 in storage device 102, objects 106 may be transported to another location, as described in more detail below with reference to FIGS. 2 and 3.

Storage device 102 may have various configurations and shapes, according to certain embodiments of the disclosure. For example, in the illustrated embodiment, storage device 102 is in an unwrapped position and has a square shape. In other embodiments, storage device 102 may have other suitable geometric shapes including, but not limited to, a rectangle, circle, and an ellipse.

Storage device 102 includes at least two layers of material 105 adapted to be rolled into a wrapped position for transportation. Although depicted and described herein as having at least two layers of material in the illustrated embodiment of storage device 102, material 105 may have several layers and material 105 will be referred to as a single article in this disclosure. In other embodiments, material 105 may include one single layer of material. In these embodiments, for example, storage device 102 may include a pocket or other similar feature for partially rigid device 107.

Material 105 may include any suitable material, such as fabric, plastic, and rubber. In one example, material 105 may include cotton fabric. In other embodiments, material 105 may include other fabric-like material, such as, but not limited to knit, wool, flannel, and acrylic material.

Material 105 may be sewn together in a first stitching border 103, according to certain embodiments. For example, first stitching border 103 may be located at the edges of storage device 102. In other embodiments, first stitching border 103 may be sewn closer to partially rigid device 107. Material 105 may include first end 111 and second end 113, so that when material 105 is in an unwrapped position, second end 113 is opposite first end 111.

According to certain embodiments, storage device 102 includes non-slip surface 110 that may have any suitable configuration. For example, also shown in the illustrated example, non-slip surface 110 is on at least one layer of material 105. In other example embodiments, non-slip surface 110 may be on both sides of material 105. In one example embodiment, non-slip surface 110 includes silicone dots. In other embodiments, however, non-slip surface 110 may be configured into other shapes or characters, such as, but not limited to letters, numbers, and animals. In yet other embodiments, non-slip surface 110 may include any other non-slip material, such as polymers, including, but not limited to polyurethane.

According to certain embodiments, storage device 102 includes partially rigid device 107 disposed between material 105. In the illustrated example, partially rigid device 107 is illustrated disposed between material 105 with certain objects 106 placed on top. Partially rigid device 107 may be included in any suitable enclosure within storage device 102. In the illustrated embodiment, for example, material 105 is sewn together with first stitching border 103 and partially rigid device 107 is enclosed within material 105 in second stitching border 104. In other embodiments, partially rigid device 107 may be included in other enclosures that may not be stitched such as a pocket in material 105.

Partially rigid device 107 may have any suitable shape, according to certain embodiments to define a flat area under at least a portion of non-slip surface 110 for placement of objects 106 when storage device 102 is in an unwrapped position. For example, partially rigid device 107 may be shaped in a square configuration defining a flat area underneath non-slip surface 110. In other embodiments, partially rigid device 107 may be shaped in any geometric configuration including, but not limited to a rectangle configuration. Such geometric configurations may be adapted to facilitate playing with object 106 such as toys when storage device 102 is in an unwrapped position.

According to certain embodiments, partially rigid device 107 may include any suitable deformable device such as, but not limited to any polymer, metal, alloy, and wooden material. For example, partially rigid device 107 may include a deformable substrate such as a bamboo mat. In other example embodiments, partially rigid device 107 may include a deformable mesh device, which may be knitted, braided, woven, or non-woven. In other embodiments, partially rigid device 107 may include a deformable plastic strip device. In yet other embodiments, partially rigid device 107 may include a deformable plastic rod device.

Partially rigid device 107 according to certain embodiments is adapted to be deformable in a first direction 115 and non-deformable in a second direction 117. In other words, in these example embodiments, partially rigid device 107 may be adapted to be rolled in first direction 115, but in second direction 117 partially rigid device 107 may not be adapted to be rolled and may be fixed to facilitate placement and playing with objects 106 when storage device 102 is in an unwrapped position.

Figure 2:
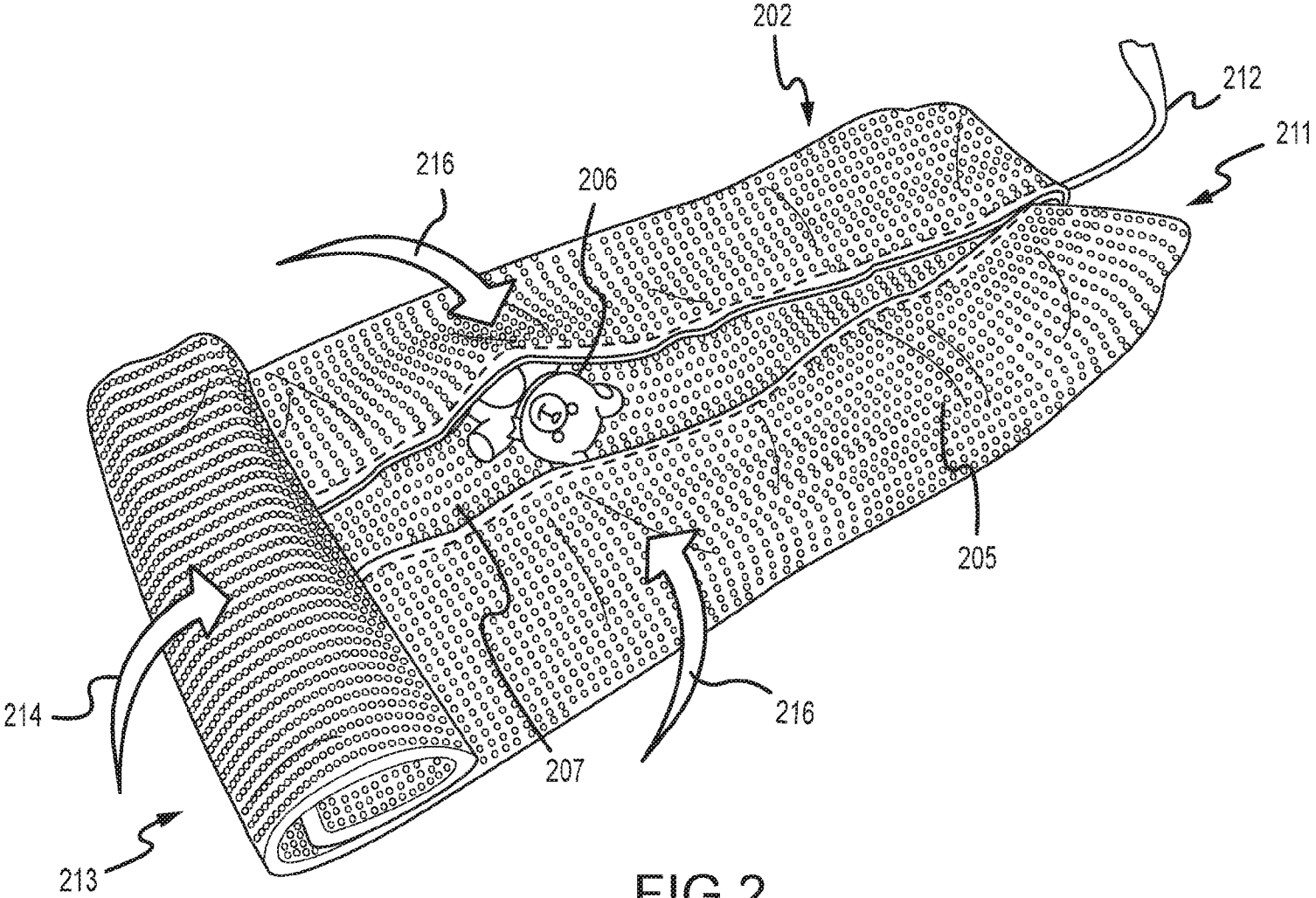
FIG. 2 illustrates an example of a storage device adapted to be rolled to store and transport objects, according to certain embodiments of the present disclosure.

FIG. 2 illustrates an example of a storage device 202 adapted to be rolled to store and transport objects 206, according to certain embodiments of the present disclosure. Storage device 202 and its embodiments are substantially similar to storage device 102 of FIG. 1 and embodiments. In the illustrated embodiment, storage device 202 includes at least two layers of material 205, partially rigid device 207, a closing device 212, and objects 206. As shown in the embodiment, storage device 202 is adapted to be rolled 214 from second end 213 of material 205 to a first end 211 of material 205.

According to certain embodiments, storage device 202 is adapted to be folded 216, as well as rolled 214. In the illustrated embodiment, for example, material 205 is folded 216 inward toward partially rigid device 207, and subsequently material 205 is rolled 214 from second end 213 toward first end 211. Objects 206, in some circumstances, are enclosed within material 205 when material 205 is rolled 214.

Partially rigid device 207, according to certain embodiments, is deformable in in the direction of rolling 214 of storage device 202. In the illustrated example, for example, partially rigid device 207 is adapted to be deformable when rolled 214 in a first direction. In these embodiments, partially rigid device 207 adapted to be non- deformable in a second direction, such as the direction of folding 216. Therefore, in these example embodiments, partially rigid device 207 may maintain its structure to facilitate folding 216 and, when storage device 202 is being rolled 214, partially rigid device 207 may deform in the direction of rolling 214 to facilitate rolling 214 storage device 202 into a wrapped position.

According to certain embodiments, storage device 202 includes closing device 212. In the illustrated example, for example, closing device is at first end 211 of material 205. Closing device 212 is adapted to secure storage device 202 in a wrapped position, as described in more detail below with reference to FIG. 3, so that objects 206 may be stored and transported.

Figure 3:
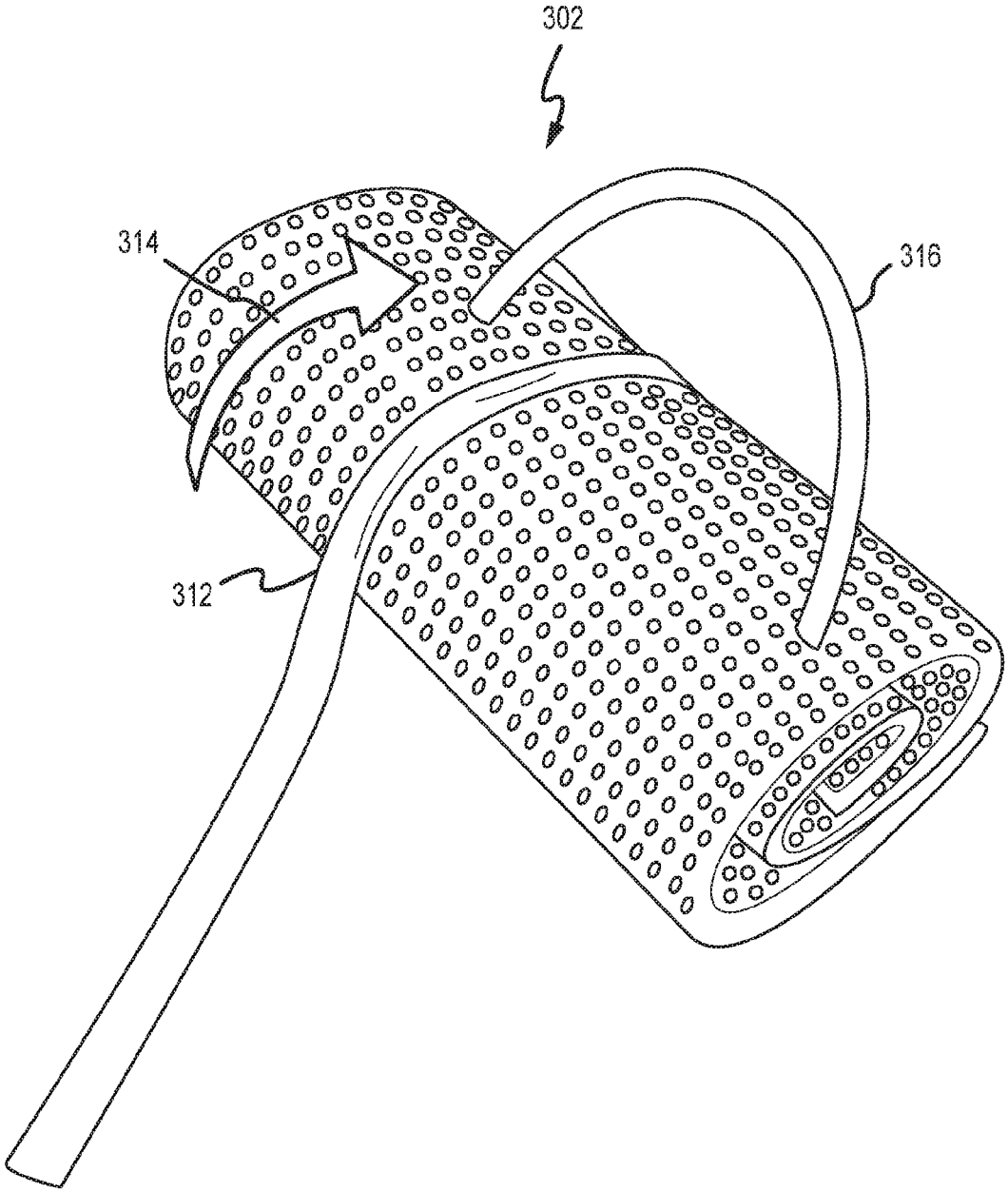
FIG. 3 illustrates an example of a storage device that is in a wrapped position and a closing device secures the storage device, according to certain embodiments of the present disclosure.

FIG. 3 illustrates an example of a storage device 302 that is in a wrapped position and a closing device 312 that secures storage device 302, according to certain embodiments of the present disclosure. Storage device 302 is substantially similar to storage device 102 of FIG. 1 and storage device 202 of FIG. 2.

According to certain embodiments, storage device 302 is adapted to be rolled 314 into a wrapped position. Storage device 302 is illustrated in FIG. 3 in one example wrapped position. Storage device 302 may be placed in other various forms of a wrapped position for transport and storage.

Storage device 302 may include any suitable closing device 312 that is adapted to secure storage device 302. For example, closing device 312 may include any closing instrument that encircles and binds storage device 302 in a wrapped position. In one example embodiment, closing device 312 includes double-sided 25 VELCRO. In other embodiments, closing device 312 may include resilient flexible material that may be adapted to form a tubular-like structure that encircles storage device 302 to secure storage device 302 when in a wrapped position. The resilient flexible material of closing device 312 may be adapted to roll-up when storage device 302 is in an unwrapped position. In other embodiments, closing device 312 may 30 include a latch. In yet other embodiments, closing device 312 may include a hook.

According to certain embodiments, storage device 302 may include any suitable carrying device 316. For example, carrying device 316 may include any carrying instrument that is adapted to allow storage device 302 to be transported when storage device 302 is in a wrapped position. In one example embodiment, carrying device 316 includes a polymer material strap, such as nylon. In other embodiments, carrying device 316 may include any material, such as, but not limited to plastic, leather, and rubber. Moreover, carrying device 316 may include buckles and clips, which may be disposed on strap and storage device 302. In other example embodiments, the carrying device 316 may include two straps that may comprise the embodiments described above.

Modifications, additions, or omissions may be made to storage device 302 without departing from the scope of the disclosure. The components of storage device 302 may be integrated or separated. Moreover, the operations of rolling and folding of storage device 302 may be performed using any suitable technique. As used in this document, "each" refers to each member of a set or each member of a subset of a set. Further details of an example for manufacturing a storage device as described herein are provided below with reference to FIG. 4.

Figure 4:
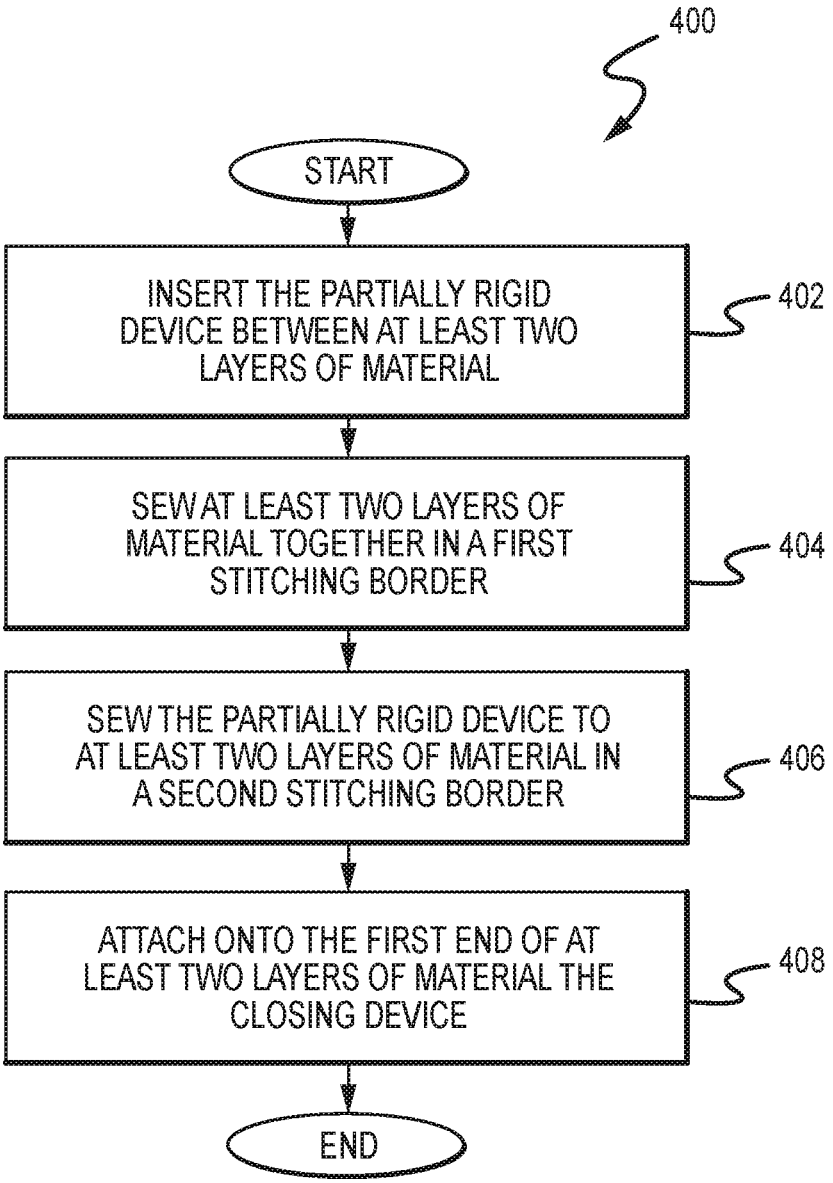
FIG. 4 illustrates an example method for manufacturing an example storage device, according to certain embodiments of the present disclosure.

FIG. 4 illustrates an example method 400 for manufacturing storage device, according to certain embodiments of the present disclosure. The method begins at step 402 where a partially rigid device is inserted between at least two layers of material. At step 404, at least two layers of material are sewn together in a first stitching border. At step 406, the partially rigid device is sewn to at least two layers of material in a second stitching border. In other example embodiments, the partially rigid device may not be sewn to the material and may enclosed within the second stitching border. At step 408, a closing device is attached onto the first end of at least two layers of material. It should be understood that some of the steps illustrated in FIG. 4 may be combined, modified, or deleted where appropriate. Additionally, as indicated above, steps may be performed in any suitable order without departing from the scope of the disclosure.

Although the present disclosure has been described with several embodiments, diverse changes, substitutions, variations, alterations, and modifications may be suggested to one skilled in the art, and it is intended that the disclosure encompass all such changes, substitutions, variations, alterations, and modifications as fall within the spirit and scope of the appended claims.

What is claimed is:

1. A storage device adapted to store and transport toys comprising:

at least two layers of material adapted to transform from an unwrapped position to a wrapped position for transportation, wherein each of the two layers of material has a non-slip surface comprising a plurality of silicone dots configured in a variety of animal shapes, wherein the at least two layers of material are sewn together by a first stitching border;

a third layer of material sewn to the at least to layers of material in a second stitching border and consisting of a partially rigid device having a plurality of edges, the third layer of material being disposed between the at least two layers of material in a pocket, wherein the plurality of edges of the partially rigid device are enclosed by the second stitching border, the partially rigid device defining a flat area under at least a portion of the non-slip surface for placement of one or more toys when the storage device is in the unwrapped position; partially rigid device includes deformable strips in a first direction and adapted to be non-deformable in a second direction;

wherein the at least two layers of material are adapted to fold over the one or more toys at the second stitching border, enclosing the flat area under the at least a portion of the non-slip surface for placement of the one or more toys and placing the storage device in the wrapped position;

a first closing device comprising a hook positioned on the at least two layers;

a second closing device comprising a latch positioned on the second end of the at least two layers, wherein the first closing device and the second closing device are adapted to encircle and secure the storage device when in the wrapped position; and a carrying device comprising a nylon strap and a plurality of buckles disposed on the at least two layers and configured to carry the storage device in the wrapped position.

* * * * *